United States Patent [19]

Hsu

[11] Patent Number: 4,722,466

[45] Date of Patent: Feb. 2, 1988

[54] TACK PUNCHER FOR AN ASSEMBLY OF TACKS

[76] Inventor: Walter Hsu, No. 156, Chen Pei Rd., Tou Liu City, Yun Lin Hsien, Taiwan

[21] Appl. No.: 49,529

[22] Filed: May 14, 1987

[51] Int. Cl.[4] ..... B25C 1/02; B25C 1/18

[52] U.S. Cl. ..... 227/63; 227/120; 227/127

[58] Field of Search ..... 227/63, 120, 127, 156

[56] References Cited

U.S. PATENT DOCUMENTS

| | | | |
|---|---|---|---|
| 2,640,985 | 6/1953 | Bygbjerg | 227/120 |
| 2,801,414 | 8/1957 | Mueller | 227/127 |
| 3,037,207 | 6/1962 | Pazan | 227/127 X |
| 3,250,308 | 5/1966 | March | 227/63 X |

FOREIGN PATENT DOCUMENTS

| | | | |
|---|---|---|---|
| 51727 | 4/1890 | Fed. Rep. of Germany | 227/63 |
| 3139995 | 4/1983 | Fed. Rep. of Germany | 227/63 |

*Primary Examiner*—Paul A. Bell

*Attorney, Agent, or Firm*—Bacon & Thomas

[57] ABSTRACT

A device for punching tacks into a penetrable surface. A long, substantially rectangular body which has a cavity formed lengthwise therein to receive an assembly of tacks. The body connects with a cylindrical punch housing which has a spring-loaded punch on its upper side. The tack assembly is spring-loaded so that the tacks comprised therein are consecutively urged into a punch cavity in said punch housing and at the end of said body, where they can be punched into the penetrable surface by the punch.

1 Claim, 8 Drawing Figures

TACK PUNCHER FOR AN ASSEMBLY OF TACKS

BACKGROUND OF THE INVENTION

This invention relates to a tack puncher for a ready-made assembly of tacks which can be used to punch tacks into a solid wall or the like quickly and conveniently. Previously, tacks were inserted into the wall by hand, and they were inserted by picking up and putting in only one at a time, which could make the user's fingers or thumbs sore. In addition, the head of tacks inserted by hand often bent about the pin of the tack, thereby ruining the tack.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a device which can be used to consecutively punch tacks into a stable surface.

Another objective of this invention is to provide a device which exerts a centered pressure on the tack while it is being punched.

A further objective of this invention is to provide an easy-sliding and easily securable top cover.

Further objectives and advantages of the present invention will become apparent as the following description proceeds, and the features of novelty which characterize the invention are pointed out with particularity in the claims annexed to and forming a part of this invention.

BRIEF DESCRIPTION OF THE DRAWINGS

FIG. 1 is a perspective view of a tack puncher according to the present invention;

FIG. 3-1 is a lengthwise cross-sectional view of a tack puncher according to the present invention before punching;

FIG. 3-2 is a lengthwise cross-sectional view of a tack puncher according to the present invention;

FIG. 3-3 is a cross-sectional view of the midsection of a tack puncher according to the present invention;

FIG. 4-1 is cross-sectional view showing the closed position of a pair of clasps according to the present invention;

FIG. 4-2 is a cross-sectional view showing the open position of the clasps of FIG. 4-1.

DETAILED DESCRIPTION OF THE PREFERRED EMBODIMENT

Figure 2:
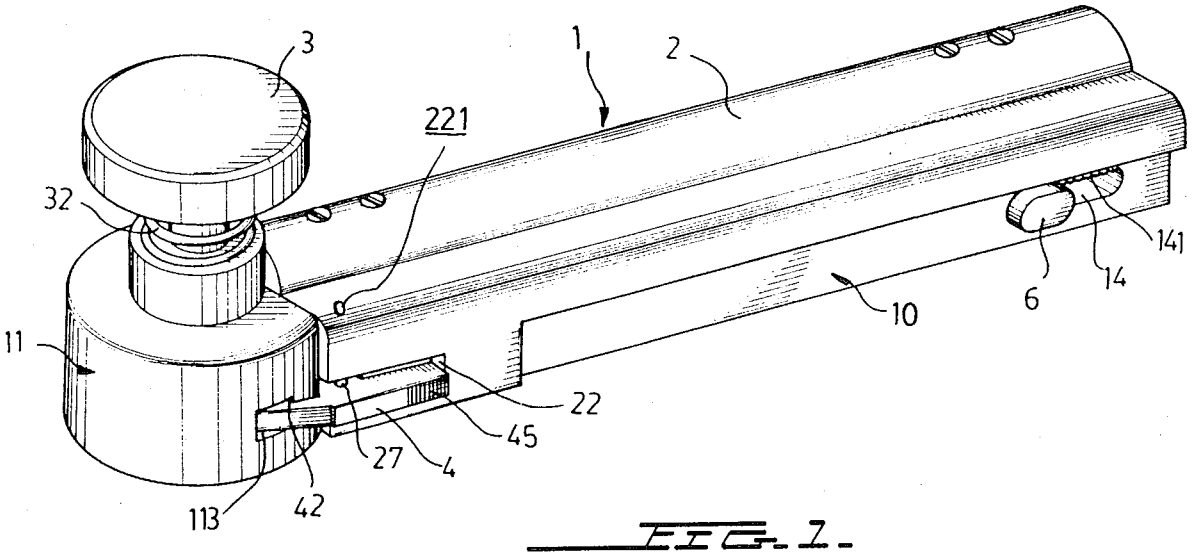
FIG. 2 is an exploded view of a tack puncher according to the present invention.
Figure 2:
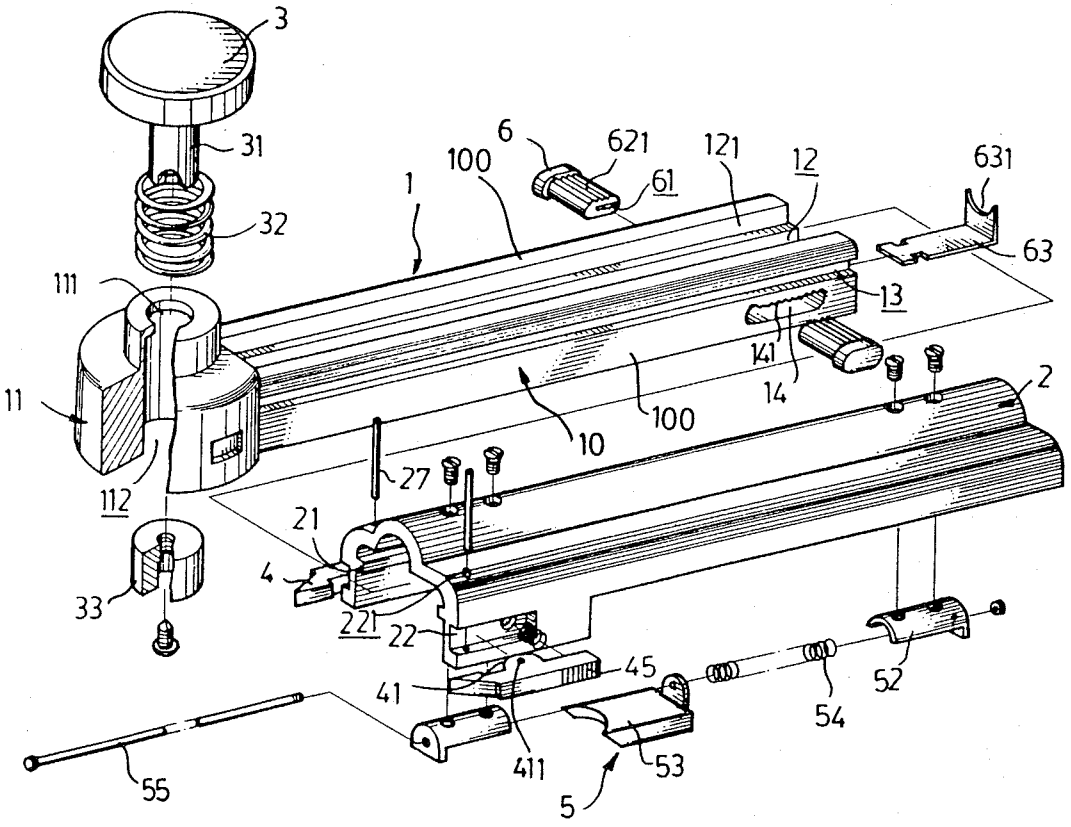
Figures 1, 3:
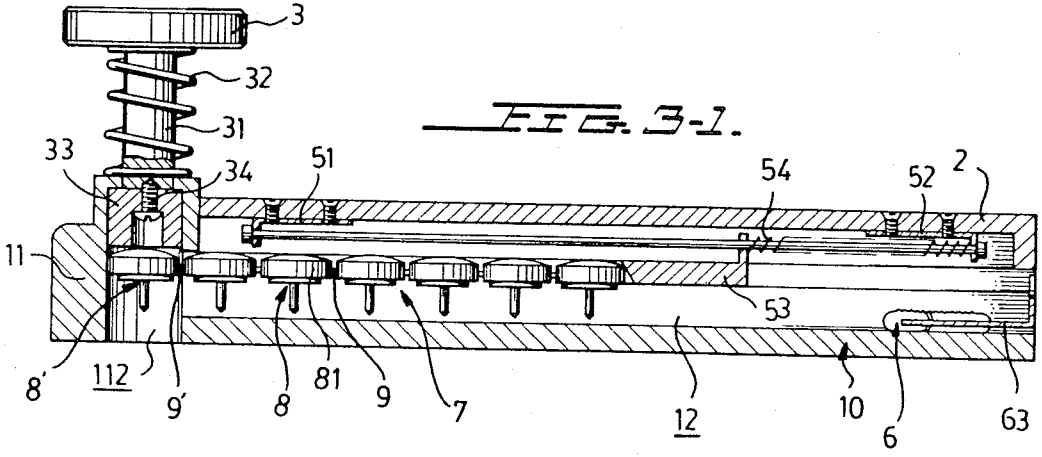
Figures 2, 3:
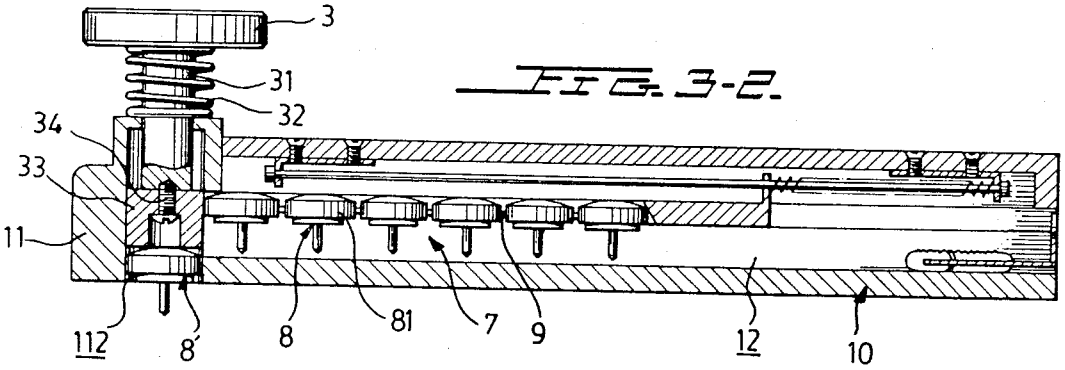
Figure 3:
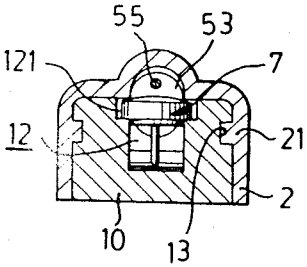
Figures 1, 4:
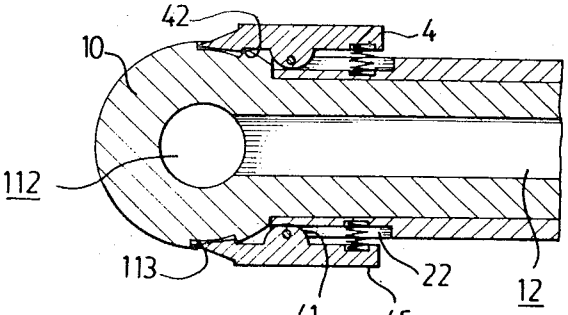
Figures 2, 4:
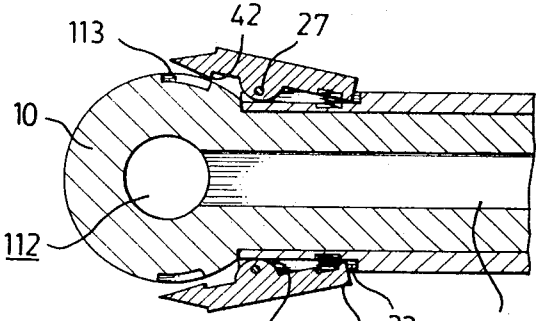

Referring to FIG. 1, it can be seen that the present invention comprises a body 10 which forms an integral piece with a punch housing 11. The body has a slidable top cover 2 thereon. The punch housing 11 has a spring-loaded punch 3 protruding from the punch post hole 111 (see FIG. 2) on the top center surface thereof. On the front side of the body 10 (i.e. towards the punch) are spring-loaded clasps 4 which keep the sliding top cover 2 in place by clasping onto the punch housing 11 until released by the user (this will be further discussed below). At the rear end of the body 10 are two slidable tack removal buttons 6.

Further referring to FIG. 2 and 3-1, the structure of the tack puncher 1 according to the present invention will be explained in detail. It can be seen that the body 10 of the tack puncher 1 has a tack assembly cavity 12 for receiving an assembly of tacks 7. This tack assembly 7 is spring-loaded by spring 54, which is attached to a retainer 53. The spring 54 is loaded between the rear rod bracket 52 and the retainer 53. The retainer 53 has a curved front edge to closely fit against the circular head of the end tack of the tack assembly 7. There is a hole corresponding to the diameter of the tack heads 81 (see FIG. 3-3) in the tack assembly, which allows the foremost tack 8' of the tack assembly to be slid through to the punch cavity 112. The retainer 53 urges the tack assembly 7 to the front of the punch cavity 112, so that one tack 8 at a time may be punched by the punch insert 33, which is fixed to the punch post 31 of the punch 3. Note that the inner circumference of the punch cavity 112 is only slightly larger than the circumference of the tack heads 81, so that the foremost tack 8' fits snugly into the punch cavity 112 while being held up by the foremost link 9'. The rest of the tacks 8 are joined together in a head-to-head manner with links 9 such that they form a straight (linear) row.

Now referring to FIG. 3-1 and 3-3, the operation of the punch portion of the present invention will be explained. Since the top cover 2 has extended projections 21 for slidable engagement along guide slots on the outer sides of the two side walls 100 (see FIG. 2) of said body 10. After the tack assembly 7 is loaded onto the tack assembly shelf 121, the retainer 53 pushes the tack assembly 7 forward until it meets with the touches the front of the punch cavity 112. Then the punch 3 is pressed by the user until the foremost tack 8' is punched out of the punch cavity. As soon as the restoring force of the punch spring 32 returns the punch 3 to its original position, the spring-loaded retainer 53 urges the tack assembly 7 forward so that the foremost tack 8' on the assembly 7 is urged forward, so that the process can be repeated if so desired.

Further referring to FIG. 1 and 2, it can be seen that on either side of the front end of said top cover 2 are spring-loaded clasps 4. These clasps 4 are pivotable about pivot rods 27 and the front claws 42 thereof are normally engaged with the clasp engagement slots 113 on the outer wall of said punch cavity 112.

One important feature of the tack puncher 1 according to the present invention is that the force from the puncher 3 is transferred directly to the punch insert 33, which in turn acts on the foremost tack 8'. The punch insert 33 is cylindrical in shape and the force acting on the tack 8' is evenly distributed, as can be understood from FIG. 3-2.

Figure 5:
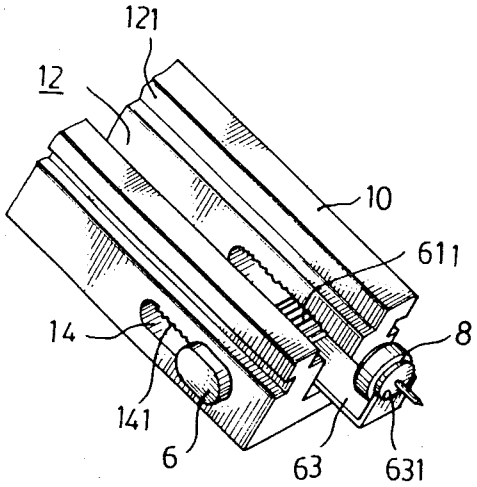
FIG. 5 is a cutaway perspective view of the rear portion of the body, without the cover, illustrating the tack removal features according to the present invention.

From FIG. 1 and 5, the operation of the tack remover 63 can be understood. The tack remover 63 has a substantially L-shaped cross-section and fits slidably into the rear end of the body 10 of the tack puncher 1. The end 631 of the tack remover 63, which is protractible from the rear end of the body 10, is curved so as to match the shape of the tack heads 81. In actual use, the curved edge 631 is slipped under a tack (not shown), and then pulled outwardly so as to dislodge the tack. The tack remover 63 is gripped on the inside end thereof with two tack removal buttons 6 in a retainer slot 61 thereon. Each of the tack removal buttons 6 fits in a slot 14 with engagement ridges 141 on the upper side thereof matching engagement ridges 611 on the upper side of the tack removal button 6. These ridges 141 and 611 keep the tack removal button from slipping out of place and exposing the sharp curved edge 631 and also are used to project the tack remover 63 to the exact distance which is required.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A tack puncher (1) comprising:

(a) a long, substantially rectangular body (10) for receiving a linear assembly of tacks;

(b) a substantially cylindrical section punch housing (11) which forms an integral piece with said rectangular body (10) and which has a hole corresponding to a profile of the tacks used in said linear assembly of tacks; said cylindrical section punch housing (11) having a punch cavity (112) therein and a punch post hole (111) on a top surface thereof for receiving a spring-loaded punch (3); a substantially cylindrical punch insert (33) which is fixed to a bottom side of said punch post (31), said punch post (31) being slidable in said punch cavity (112);

(c) a top cover (2) which has extended projections (21) for slidable engagement along guide slots (13) on outer sides of two side walls of said body (10); said top cover (2) having a clasp (4) on either side of a front end of said top cover which is spring-loaded so as to be normally engaged with a clasp engagement slot (113) on the outer cylindrical wall of said punch cavity (112); each of said clasps (4) being hinged about a respective pivot rod (27) set at the front end of said top cover (2);

(d) a spring-loaded retainer (53) for urging said assembly of tacks towards a front side of said punch cavity (112), a spring (54) thereof being loaded between a rear rod bracket (52) which is fixed to a top rear end of said top cover (2) and said retainer (53), and said spring (54) being aligned on a spring rod (55) which is fixed to said rear rod bracket (52) on one end and which is fixed to a front rod bracket (51) on another end, said front rod bracket (51) being fixed to a top front end of said top cover (2); and (e) a tack remover (63) which is slidably protractible from a rear end of said rectangular body (10), said tack remover (63) having a substantially L-shaped cross-section, said tack remover (63) also having a curved edge (631) on one end thereof, said tack remover (63) being retained by a retainer slot (61) of two tack removal buttons; said tack removal buttons (6) each being movable in a slot (14) on either side of said body (10); each of said tack removal buttons (6) having engagement ridges (611) on a top surface thereof which engage with body engagement ridges (141) on an upper side of said slots (14).

* * * * *